United States Patent [19]

Player et al.

[11] 4,109,437

[45] Aug. 29, 1978

[54] BUILDING PANEL

[75] Inventors: Wayne H. Player, Mesquite; Forris W. Barton, Jr., Grand Prairie, both of Tex.

[73] Assignee: Howmet Corporation, New York, N.Y.

[21] Appl. No.: 782,768

[22] Filed: Mar. 30, 1977

[51] Int. Cl.[2] ..... E04D 1/06

[52] U.S. Cl. ..... 52/536; 52/478; 52/588

[58] Field of Search ..... 52/588, 536, 537, 538, 52/145, 478, 492

[56] References Cited

U.S. PATENT DOCUMENTS

| | | | |
|---|---|---|---|
| 2,098,717 | 11/1937 | Calkins | 52/492 |
| 2,180,317 | 11/1939 | Davis | 52/588 |
| 3,524,292 | 8/1970 | Bottom | 52/536 |

FOREIGN PATENT DOCUMENTS

| | | | |
|---|---|---|---|
| 860,565 | 1/1971 | Canada | 52/588 |
| 1,507,634 | 12/1967 | France | 52/588 |
| 58,584 | 11/1967 | German Democratic Rep. | 52/145 |
| 1,292,358 | 10/1969 | Fed. Rep. of Germany | 52/588 |
| 1,249,997 | 10/1971 | United Kingdom | 52/588 |

*Primary Examiner*—Ernest R. Purser
*Assistant Examiner*—Henry Raduazo
*Attorney, Agent, or Firm*—Thomas L. Cantrell; Joseph H. Schley

[57] ABSTRACT

Disclosed is a channel shaped building panel especially adapted for installation on the underside of a roofing framework. The panel has opposed upstanding webs, one of which is provided with outwardly oriented generally L-shaped female locking and mounting means, and the other of which is provided with an inwardly oriented male locking means, both locking means terminating in detent ribs. At the juncture of the female locking means with its web, an integral inwardly oriented scabbard is formed, and a complementary outwardly oriented integral blade is formed at the juncture of the male locking member with its web. Upon upward insertion of the male locking member into the female locking member, the detent ribs interact in snap fashion, and the blade seats in the scabbard. The female locking and mounting member provides a surface for attachment of a fastener to the roofing framework. In one form of the invention, the male locking member provides such a surface also; in another form it is shaped to provide clearance room for the head of such a fastener.

8 Claims, 8 Drawing Figures

BUILDING PANEL

BACKGROUND OF THE INVENTION

Construction panels are generally formed from sheet aluminum or steel, and they are frequently webbed on their long sides to provide longitudinal stiffening. The edges of the panels, or their webs, are often formed or developed in special configurations so that panels placed side by side may be interlocked to each other along their edges. Many different configurations of interlocking means have proposed or placed into use. Among them are those shown in U.S. Pat. Nos. 1,198,764; 1,429,400; 1,913,342; 2,019,379; 2,302,949; 3,055,461; 3,100,556; 3,131,794; 3,234,697; 3,276,171; 3,394,524; 3,462,906; 3,481,094; 3,606,718; 3,608,267 and 3,969,866.

Roofing panels are a special form of construction panel. It is desirable that roofing panels be capable of installation on the underside of a roofing framework from below the framework. This circumstance makes many panel interlocking systems impractical or inconvenient for roofing panels, including those which involve rotation of one panel with respect to another in the course of installation, or telescoping of panel edges together, or the use of fastening systems which are exposed or which require access to space above the roofing framework.

Furthermore, it is necessary that a roof formed of roofing panels have sufficient integral strength when assembled to avoid sagging and uneveness even though it is attached to the framework at relatively widely spaced points.

SUMMARY OF THE INVENTION

In accordance with the present invention, an improved roofing panel is provided which is particularly well adapted for installation on the underside of a roofing framework from below the framework. The roofing panels of the invention are preferably roll formed from sheet aluminum or sheet steel into channel shaped members of desired length having upstanding webs on their long sides. Special locking means are provided along the upper edges of the webs to provide for attachment of the panels to the underside of a roofing framework, and to each other, with the installation work being done from beneath the roofing level.

The locking means are preferably integrally formed from the material of the panel webs and thus comprise special developments of the panel edges. The female locking means is oriented outwardly of the web on which it is carried, and is generally in the shape of an inverted "L". The base of the "L", the mounting flange, is generally parallel to the main plane of the panel and is adapted to abut against the underside of a roofing framework member, typically an I-beam, so that a fastener such as a self-tapping screw may be driven through the area of abutment to attach the panel to the framework. The inverted "L" may thus be aptly termed a mounting and locking means. The leg of the "L" depends from the mounting flange and terminates in an inwardly oriented detent rib.

At the point where the mounting flange of the female locking means intercepts the plane of the web on which it is carried, there is formed, in accordance with the invention, a narrow scabbard which is oriented inwardly of the web. In its preferred form, the scabbard is formed integrally with the web and "L", and is oriented slightly downwardly as well as inwardly.

The male locking means is proportioned to interlock with the female mounting and locking means of an adjacent panel. It comprises an inwardly oriented leg terminating in an inwardly oriented detent rib. In accordance with the invention, the profile of the male locking means may take one of two forms, depending upon whether it is desired to be able to apply the fasteners from below or above the roof level. If the first is the case, the male locking means comprises a leg which extends first downwardly along the side of the web, and then inwardly and downwardly at an angle to terminate in an inwardly oriented detent rib. This configuration provides room within the locking means when assembled to accommodate the head of a fastener such as a screw or rivet.

If, on the other hand, a system is desired in which the fasteners are applied from the top and engage both the female and male locking means, the leg of the male locking means extends first inwardly and then inwardly and downwardly to terminate in an inwardly oriented detent rib. The inwardly extending portion of the leg abuts the mounting flange of the female lock when two panels are locked together, and the shaft of a fastener may be driven from above through both of them.

At the point of juncture between the male locking member and the web on which it is carried there is formed a narrow blade oriented outwardly of the web. The blade is preferably integrally formed with the web and leg, and is proportioned to fit into the scabbard of a female locking means when two adjacent panels are interlocked.

When two panels of the invention are interlocked to form a section of roofing, the male locking means of one panel is forced upwardly into the female locking means of the other panel. As the detent ribs of the two locking means come into contact, the legs of the locking means are momentarily resiliently deformed until the rib of the male locking means snaps upwardly past the rib of the female locking means. The snap action impels the panel carrying the male locking member toward the other panel to seat the blade in the scabbard. The scabbard-and-blade interconnection of the panels resists downward force applied by one panel upon the other.

From the foregoing, it can be seen that a principal object of the present invention is to provide an improved roofing panel which may be readily and securely assembled and attached to the underside of a roofing framework by installers working in the main, or entirely, from positions under the framework.

This object, together with other objects and purposes, may best be understood by a consideration of the detailed description which follows, together with the accompanying drawings.

DESCRIPTION OF THE PREFERRED EMBODIMENTS

Figure 1:
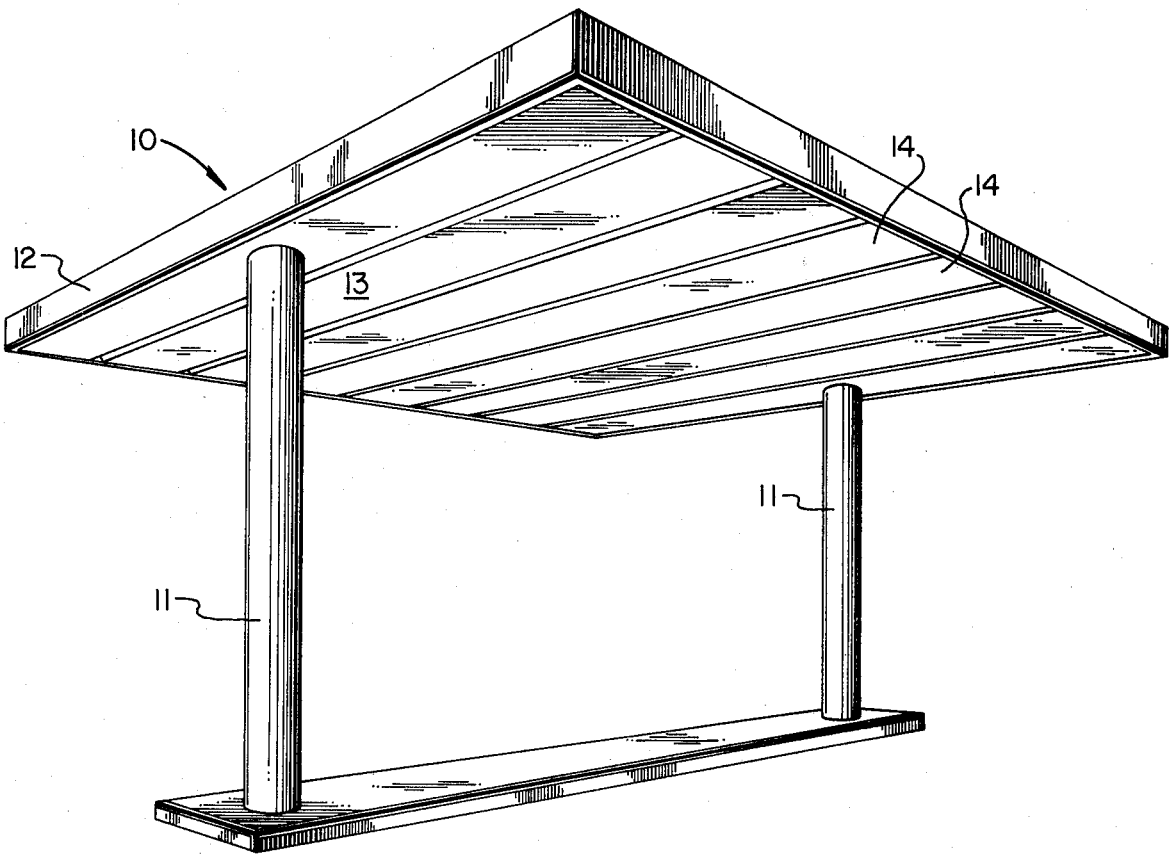
FIG. 1 is a perspective view of a service station canopy with a roof formed of panels of the invention installed therein.

FIG. 1 illustrates a canopy 10 of the kind commonly installed over pump islands at service stations. The canopy structure includes supports 11, a facia 12 which surrounds and conceals a roofing framework formed of I-beams. Beneath the roofing framework is mounted roof 13, made up of a series of panels 14, arranged in side-by-side relationship, and interlocked together. Canopy 10 represents a typical building structure in which roofing panels are mounted to the underside of a roofing frame.

Figure 2:
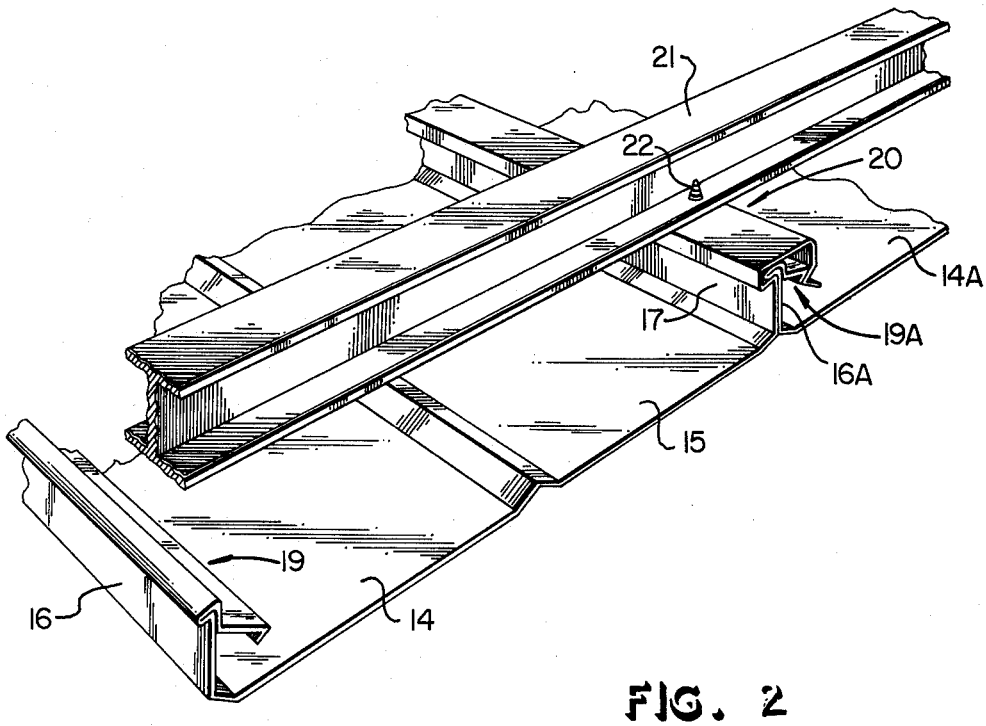
FIG. 2 is an enlarged top perspective view of a portion of a roof constructed in accordance with the invention, with portions of two interlocked panels and a portion of a roofing framework being shown.

From FIG. 2 it can be seen that panel 14 is in the form of a shallow channel with a substantially planar main surface 15, and upstanding webs 16, 17. A rib 18 may be formed in main surface 15 for aesthetic and strength-enhancing purposes, if desired, and more than one such rib may be provided. Also, a bevel may be provided at the intersection of webs 16 and 17 with planar main surface 15.

An integral male locking means designated generally as 19 is formed on the upper edge of web 16, and an integral female mounting and locking means designated generally as 20 is formed on the upper edge of web 17.

Positioned next to panel 14 is like panel 14A, whose web 16A and male locking means 19A can be seen in FIG. 2. Webs 17 and 16A are in abutting relation, and male locking means 19A is inserted upwardly into and interlocked with female locking and mounting means 20. The upper planar portions of female locking and mounting means 20 is adapted for abutment against the underside of I-beam 21, which is an element of a roofing framework. A screw fastener 22 connects panel 14 to I-beam 21 in the region of abutment.

Figure 3:
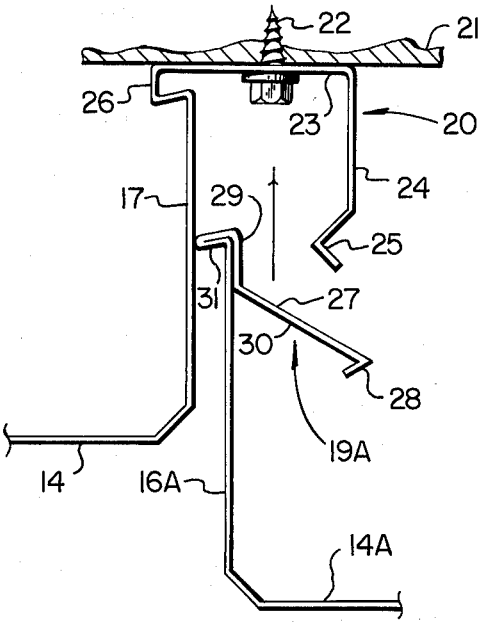
FIGS. 3 through 6 are sequential fragmentary and elevational views, partly in section, of adjacent panels of the invention being installed on the underside of a roofing framework and locked together.

The structure of the male and female locking means may best be understood from FIG. 3. Female locking and mounting means 20 is preferably integrally formed as a development of the upper edge of web 17 of panel 14. It is generally in the shape of an inverted "L", with a substantially planar leg 23 extending outwardly from web 17 in abutment with the underside of I-beam 21. Fastener 22 connects the leg 23, and thus panel 14, to beam 21. At the outer end of leg 23 is positioned downwardly extending leg 24, which terminates in an inwardly oriented detent rib 25.

At the point where leg 23 intercepts the plane of web 17, an integral inwardly extending narrow scabbard 26 is formed. In addition to extending inwardly, scabbard 26, or at least the bottom thereof, preferably extends downwardly at a slight angle from the horizontal, preferably about ten degrees.

The male locking means 19A is preferably integrally formed as a development of the upper edge of web 16A, and comprises leg 27 which extends downwardly and inwardly to a termination in detent rib 28. In the embodiment shown in FIGS. 2-6, leg 27 has two distinct sections, the first being a straight downwardly extending section 29, and the second being a downwardly and inwardly extending section 30. An important advantage of this arrangement is that clearance space is created for the head of fastener 22 when the parts are fully interlocked (See FIG. 6).

Figure 6:
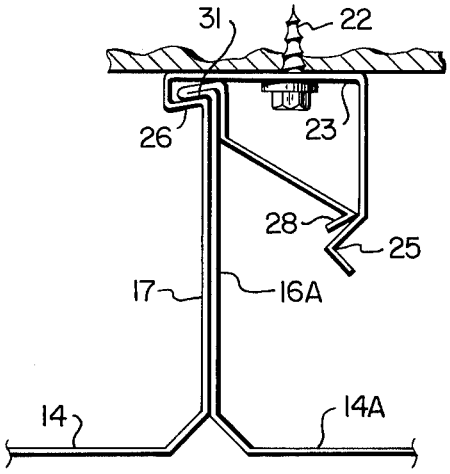

At the juncture between leg 27 and web 16A there is formed narrow blade 31 which is oriented outwardly of web 16A. As can be seen in FIG. 3, blade 31 is preferably integrally formed by folding of the material of the web. FIG. 6 shows that blade 31 is proportioned and positioned to fit into scabbard 26. Like the scabbard, it is preferably angled slightly downwardly from the horizontal, preferably about ten degrees.

A consideration of FIGS. 3 through 6, together and sequentially, will give an understanding of the dynamics of the interlock system of the invention.

In FIG. 3, panel 14 is attached to I-beam 21 by means of fastener 22 before panel 14A is brought into position beside it. Because of the open bottom of female mounting and locking means 20, ready access may be had to the underside of leg 23 for tools used to install fastener 22. Panel 14A is then brought into the position shown in FIG. 3, and is pushed upwardly as indicated by the arrow in that FIG.

Figure 4:
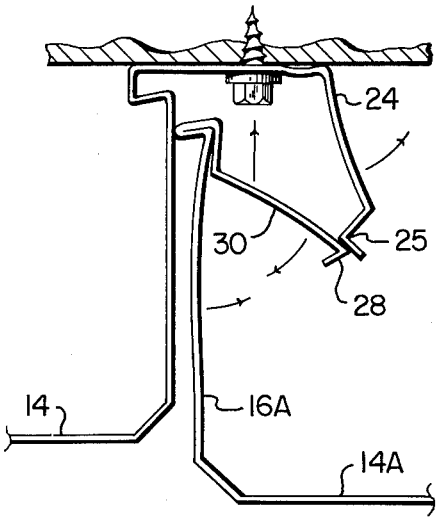

Upward movement of panel 14A brings detent ribs 28 and 25 into contact, as is shown in FIG. 4. As the panel is pushed upwardly, leg section 30 of the male locking means and leg 24 of the female locking means flex away from each other, as indicated by the arcuate arrows in FIG. 4, so the rib 28 can slide past rib 25. During this movement web 16A flexes also, as indicated by the arcuate arrow in FIG. 4.

Figure 5:
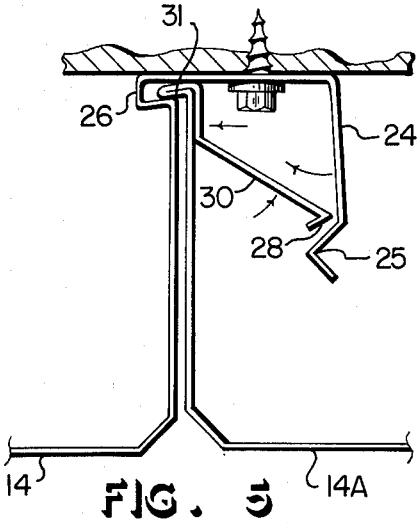

FIG. 5 shows the locking means just as detent rib 28 has snapped past detent rib 25. As is indicated by the arcuate arrows in that FIG., legs 24 and 30 thereupon flex back toward their unstressed positions. At the same time, blade 31 is lifted to the level of scabbard 26, and the violence of the snap action just described impels panel 14A to the left as FIG. 5 is drawn, this movement being indicated by the horizontal arrow in FIG. 5. Blade 31 thus starts to enter scabbard 26.

FIG. 6 shows the parts at rest, with the interlock completed. Blade 31 is fully seated in scabbard 26, and detent rib 28 is locked and seated above detent rib 25. Web 16A is abutted against web 17. Clearance room sufficient for the head of fastener 22 is provided. It should also be noted that the weight load of panel 14A is applied to fastener 22 through leg 23 from both sides and not merely one, in cantilever fashion. Part of the load is applied at blade 31 and scabbard 26, on the left, and the rest is applied at the interlock of ribs 25 and 28 on the right.

Figure 7:
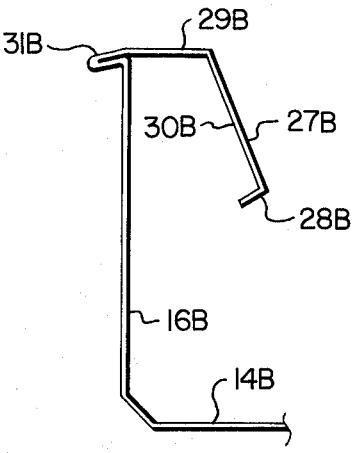
FIG. 7 is a fragmentary end elevational view of a panel of the invention constructed with an alternate form of male locking means.
Figure 8:
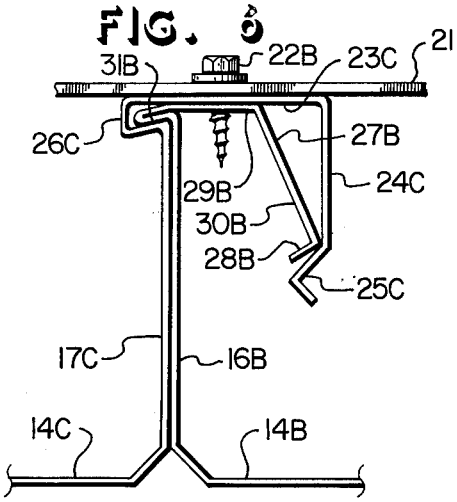
FIG. 8 is a fragmentary end elevational view of a pair of panels locked together, the male locking means being that of FIG. 7.

FIGS. 7 and 8 show another embodiment of the invention in which the male locking means is given an alternate configuration to specially adapt the locking and mounting system of the invention to applications where it is desired to apply the fasteners from above the level of the roof.

In FIGS. 7 and 8 the parts are given the same reference characters as in the prior FIGS. with the superscripts "B" and "C" added to indicate the right and left panels respectively. The male locking means of FIGS. 7 and 8 differs from that shown in FIGS. 2-6 in that its leg 27B has a section 29B which extends substantially straight inwardly from web 16B instead of straight downwardly as did leg section 29 of FIG. 3. Section 29B is thus in abutment with leg 23C of the female locking and mounting means, so that fastener 22B may be driven through both of them, as appears in FIG. 8.

We claim:

1. A roofing panel especially adapted for installation on the underside of a roofing framework comprising:

a generally planar elongated member having upstanding webs along its long sides;

one of said webs being provided with a female mounting and locking means oriented outboard of said web;

said female mounting and locking means comprising:

an integral flange formed at the top of its web into an inwardly extending narrow scabbard having a mouth substantially as wide as two thicknesses of panel forming material;

an outwardly extending substantially planar leg positioned parallel to the surface of said planar member and adapted for abutment against the underside of a ceiling framework member, thereby providing for application of a fastener connecting said roofing panel to said framework member;

and a downwardly extending leg spaced from and substantially parallel to said web, said downwardly extending leg terminating in an inwardly oriented detent rib;

said male locking means comprising:

an integral flange formed at the top of its web into an outwardly extending narrow blade having a thickness substantially equal to two thicknesses of panel forming material;

and an inwardly and downwardly extending leg terminating in an inwardly oriented detent rib;

whereby upon assembly of a pair of said roofing panels into interlocked relation with adjacent webs juxtaposed, the male locking means of one panel is inserted upwardly into the female locking means of the other panel with the detent rib of the male locking means snapped past and above the detent rib of the female locking means and with the narrow blade of the male locking means inserted into the narrow scabbard of the female locking means, and whereby during said assembly, energy for inserting said blade into said scabbard is momentarily stored as spring energy in the flexure of said downwardly extending legs of said male and female locking means.

2. A roofing panel especially adapted for installation on the underside of a roofing framework comprising:

a generally planar elongated member having upstanding webs along its long sides;

one of said webs being provided with a female mounting and locking means oriented outboard of said web;

the other of said webs being provided with a male locking means oriented inboard of said web;

said female mounting and locking means comprising:

an integral flange formed at the top of its web into an inwardly extending scabbard;

an outwardly extending substantially planar leg positioned parallel to the surface of said planar member and adapted for abutment against the underside of a ceiling framework member, thereby providing for application of a fastener connecting said roofing panel to said framework member;

and a downwardly extending leg spaced from and substantially parallel to said web, said downwardly extending leg terminating in an inwardly oriented detent rib;

said male locking means comprising:

an integral flange formed at the top of its web into an outwardly extending blade;

and an inwardly and downwardly extending leg terminating in an inwardly oriented detent rib;

whereby upon assembly of a pair of said roofing panels into interlocked relation with adjacent webs juxtaposed, the male locking means of one panel is inserted upwardly into the female locking means of the other panel with the detent rib of the male locking means snapped past and above the detent rib of the female locking means and with the blade of the male locking means inserted into the scabbard of the female locking means;

and in which said inwardly and downwardly extending leg of said male locking means extends first substantially straight downwardly and then downwardly and inwardly, to thereby provide clearance room between said leg and the outwardly extending planar leg of said female mounting and locking means of an adjacent interlocked roofing panel to accommodate the head of a fastener connecting said outwardly extending leg to the underside of a roofing framework.

3. A roofing panel in accordance with claim 1 in which said inwardly and downwardly extending leg of said male locking means extends first substantially straight inwardly and then inwardly and downwardly, to thereby provide a region in which said leg is abutted against the outwardly extending planar leg of said female mounting and locking means of an adjacent interlocked roofing panel to accommodate the shaft of a fastener connecting both of said legs to the underside of a roofing framework.

4. A roofing panel in accordance with claim 1 in which said scabbard is oriented downwardly as well as inwardly and said blade is oriented downwardly as well as outwardly.

5. A roofing panel in accordance with claim 4 in which the downward inclination of said scabbard and said blade is about 10°.

6. In a roofing panel of the kind having a pair of parallel upstanding webs extending along opposite sides thereof, with one of said webs being provided with a downwardly facing generally L-shaped outwardly oriented integral female locking means having a detent lock at the distal end thereof, and the other of said webs being provided with a downwardly facing inwardly oriented integral male locking means having a detent lock at the distal end thereof, the improvement comprising:

an integral inwardly oriented narrow scabbard having a mouth substantially as wide as two thicknesses of panel forming material formed between said one web and said female locking means; and an integral outwardly oriented narrow blade having a thickness substantially equal to two thicknesses of panel forming material formed between said other web and said male locking means;

said scabbard and blade each being positioned and sized to mate with complementary scabbards and blades on adjacent roofing panels of the same configuration, and to be mated by force derived from flexure of parts of said male and female locking means during engagement of said distal detent locks.

7. The improvement defined in claim 6 in which said scabbard is oriented downwardly as well as inwardly and said blade is oriented downwardly as well as outwardly.

8. The improvement defined in claim 7 in which the downward inclination of said scabbard and said blade is about 10°.

* * * * *